US008944871B2

(12) United States Patent
Evensen

(10) Patent No.: US 8,944,871 B2
(45) Date of Patent: Feb. 3, 2015

(54) SYSTEM FOR HANDLING A TRANSFER DEVICE

(75) Inventor: Geir Evensen, Straume (NO)

(73) Assignee: Framo Engineering AS, Bergen (NO)

( * ) Notice: Subject to any disclaimer, the term of this patent is extended or adjusted under 35 U.S.C. 154(b) by 356 days.

(21) Appl. No.: 13/574,619

(22) PCT Filed: Feb. 2, 2011

(86) PCT No.: PCT/NO2011/000040

§ 371 (c)(1),
(2), (4) Date: Mar. 6, 2013

(87) PCT Pub. No.: WO2011/096819

PCT Pub. Date: Aug. 11, 2011

(65) Prior Publication Data

US 2013/0157535 A1 Jun. 20, 2013

(30) Foreign Application Priority Data

Feb. 2, 2010 (NO) ..... 20100159

(51) Int. Cl.
*B63B 22/02* (2006.01)
*B63B 27/24* (2006.01)

(52) U.S. Cl.
CPC ..... *B63B 22/023* (2013.01); *B63B 27/24* (2013.01)
USPC ..... 441/5

(58) Field of Classification Search
USPC ..... 441/3–5
IPC ..... B63B 22/021
See application file for complete search history.

(56) References Cited

U.S. PATENT DOCUMENTS

| | | | | |
|---|---|---|---|---|
| 3,211,127 | A | 10/1965 | Pieter | |
| 3,605,668 | A * | 9/1971 | Morgan | 114/293 |
| 3,614,869 | A | 10/1971 | Flory et al. | |
| 3,735,435 | A | 5/1973 | Mikulicic et al. | |
| 3,883,912 | A * | 5/1975 | Pedersen | 441/5 |
| 5,275,510 | A | 1/1994 | De Baan et al. | |
| 6,502,526 | B1 * | 1/2003 | Aarsnes et al. | 114/293 |
| 6,558,215 | B1 * | 5/2003 | Boatman | 441/5 |
| 8,152,580 | B2 * | 4/2012 | Straume et al. | 441/4 |

FOREIGN PATENT DOCUMENTS

| | | |
|---|---|---|
| FR | 2656274 | 6/1991 |
| FR | 2768457 | 3/1999 |
| GB | 2273087 | 6/1994 |

* cited by examiner

*Primary Examiner* — Stephen Avila
(74) *Attorney, Agent, or Firm* — Conley Rose, P.C.

(57) ABSTRACT

A system for handling a transfer device (10) for transferring load from a storage facility, sub sea or integrated in the production facility (1) to a vessel on the sea surface (2) comprising: a pickup line (11) comprising a first end (11*a*) connected to the transfer device (10) and a second end (11*b* & 11*c*) available at the sea surface (2); a connection device (13) for connection of the transfer device (10) to the tension buoy (14); a swiveling device (20) for rotation of the connection device (13) in relation to the tension buoy (14); and a position limiting device (21) fixed to the connection device (13), for limiting the position of the pickup line (11) in relation to the tension buoy (14).

11 Claims, 9 Drawing Sheets

Figure 1: Prior art

SYSTEM FOR HANDLING A TRANSFER DEVICE

TECHNICAL FIELD OF THE INVENTION

The invention relates to a system for handling a transfer device for transferring fluid loads from a sub sea tension buoy to a vessel on the sea surface.

BACKGROUND OF THE INVENTION

In order to transfer oil and gas fluids from a storage tank on the seabed to a transport tanker, it is known to use a loading riser supported by a tension buoy anchored to the seabed by a rigid main riser. A pick up line from the end of the loading riser is connected to a marker buoy which floats on the surface of the sea. The tension buoy and loading riser are maintained below the sea surface. Normally, only the marker buoy is evident on the surface of the sea. However, problems of entanglement between the rigid main riser and the loading riser have been experienced as the tanker hauls in the marker buoy to draw up the loading riser.

One example of such a system is described below in detail with reference to FIGS. 1 and 2.

A prior art system for transferring load from a storage tank 1 (located as a separate unit sub sea or integrated into a production platform/vessel) to a tanker 2 on the sea surface is illustrated in FIGS. 1 and 2. Here, the load is a hydrocarbon fluid comprising oil, gas and/or other components from the storage tank 1, flowing to a riser base 3 via the flow line 1 a and further up a main riser 4, through a tension buoy 14 and further through an active transfer device (collectively 13 and 20)

The active transfer device located on top of the tension buoy 14 comprises a swivel 20 and a gooseneck 13 leading up from a loading riser 10. The loading riser 10 may be a flexible riser or hose, which hangs freely down from the swivel/gooseneck on the tension buoy 14 when not in use (i.e. on standby) as shown in FIG. 2. When in use, the loading riser 10 is connected to the tanker 2, and the swivel gooseneck 13 is free to swivel in order to keep the tanker 2 downwind from the tension buoy 14 as the wind shifts direction during loading as illustrated in FIG. 1.

In order to transfer the loading riser 10 from the standby mode (hanging down), to the loading mode (when it is connected to the tanker 2), a pick up system is required. A pick up system can be implemented in many ways, but the pick up system associated with the present invention may comprise the following known elements: A pick up line 11 runs from the free end of the loading riser 10 (the end valve) to a spring buoy 15 near the level of the tension buoy 14. An intermediate pick up line 11*a* runs to a master link 16 some 15 m below the sea surface 5. An upper pick up line 11*b* runs from the master link 16 to a marker buoy 17 at the sea surface. The present invention may also work with other configurations of a pick up system. Hence the pick up system is not part of the invention.

During connection the tanker moves close to the marker buoy 17, picks it up and connects it to the tanker's pull in line 18 and so to the master link 16. The tanker's pull in line 18 is connected to a winch which is a part of the tanker's tension buoy 19. The winch is activated and pulls the pull in line 18 and the pick up line 11*a* in towards the tension buoy 19. The loading riser 10 end valve follows the pick up line and engages in the tension buoy 19 when the pick up line is pulled in to its end. Transfer of the hydrocarbons can now start.

After transfer of the load to the tanker, the loading riser 10 and the pick up system 11 needs to be disconnected. The tanker's pull in line 18 is paid out until the master link 16 appears in the connection device on the tanker's tension buoy 19. At this point the loading riser 10 is again in a vertical position. The upper pick up line 11*b* and the marker buoy 17 are then connected to the master link 16 and the pull in line 18 is disconnected. The upper pick up in line 11*b* and the marker buoy 17 are again an integral part of the pick up system 11. They are then thrown overboard and the tanker leaves the site. The system is now again in the standby mode.

The system described above is a very simple pickup system. It works well during loading and disconnection operations, but it runs a significant risk of becoming entangled in the swivel/gooseneck details 20 and 13 as well as wrapping itself around the rigid riser 4 during standby operation. If this occurs, the pick up process will become impossible without the aid of a remotely controlled vehicle to disentangle the system. This is why the industry has in the past employed much more elaborate and expensive pick up systems, where this particular risk is eliminated. Such systems become exceedingly expensive as well as cumbersome from an operational point of view in deep water, and finally at some depth they are no longer a feasible alternative.

An objective of the present invention is to prevent the pickup line from becoming entangled as well as wrapped around the rigid riser. The invention enables the use of a simple pick up system, such as that described above. As a result water depth is no longer a critical parameter for loading systems like the one described above (or for similar systems).

SUMMARY OF THE INVENTION

The mechanism of the invention is a position limiting device 21, for example in the form of a wheel (with a diameter significantly larger than that of the tension buoy), located above the swivel/gooseneck active transfer device. The wheel centre is in the centre line for the vertical swivel motion and it rotates with the swivel.

The wheel circumference is equipped with devices that "catch" the pick up line if it comes in touch with it. Hence, the position limiting device 21 may also be denoted a "catching wheel" or a "catchwheel".

The invention provides a system for handling a transfer device for transferring fluid loads from a subsea tension buoy to a vessel on the sea surface, comprising:

- a connection device for connection of the transfer device to the tension buoy, where the transfer device is hanging from the connection device when no fluid loads is being transferred;
- a pickup line comprising a first end connected to the transfer device and a second end available at the sea surface;
- a swiveling device connected between the connection device and the tension buoy for rotation of the connection device in relation to the tension buoy;
- a position limiting device fixed above the connection device, for limiting the position of the pickup line in relation to the tension buoy; where the pickup line is provided in a tensioned state at least up to the level of the position limiting device.

In one aspect the swiveling device is provided for free rotation of the connection device substantially in a horizontal plane according to influence from the sea.

In one aspect the position limiting device comprises a catching device for catching and holding the pickup line.

In one aspect the catching device comprises a releasing mechanism for releasing the pickup line from the catching device.

In one aspect the releasing mechanism is provided for release of the pickup line when a traction force in the pickup line reaches a predetermined limit.

In one aspect the catching device comprises a pair of catching arms provided substantially in parallel with, and outside of, the periphery of the position limiting device, where an opening is provided between the pair of catching arms for catching the pickup line between the catching arms and the periphery of the position limiting device.

In one aspect the opening between the pair of catching arms is provided with a locking device for preventing the pickup line from exiting from the catching device through the opening.

In one aspect the catching arms are pivotally fastened to a peripherical member of the position limiting device.

In one aspect the catching arms are pretensioned by means of a spring device.

In one aspect the catching device comprises substantially T-shaped catching elements protruding from the position limiting device.

In one aspect the position limiting device is substantially circular.

BRIEF DESCRIPTION OF THE DRAWINGS

Specific embodiments of the invention (and typical prior art) will now be described in detail by way of example with reference to the accompanying drawings, in which:

FIG. 8 illustrates an alternative embodiment of the catching device, and.

Figure 1:
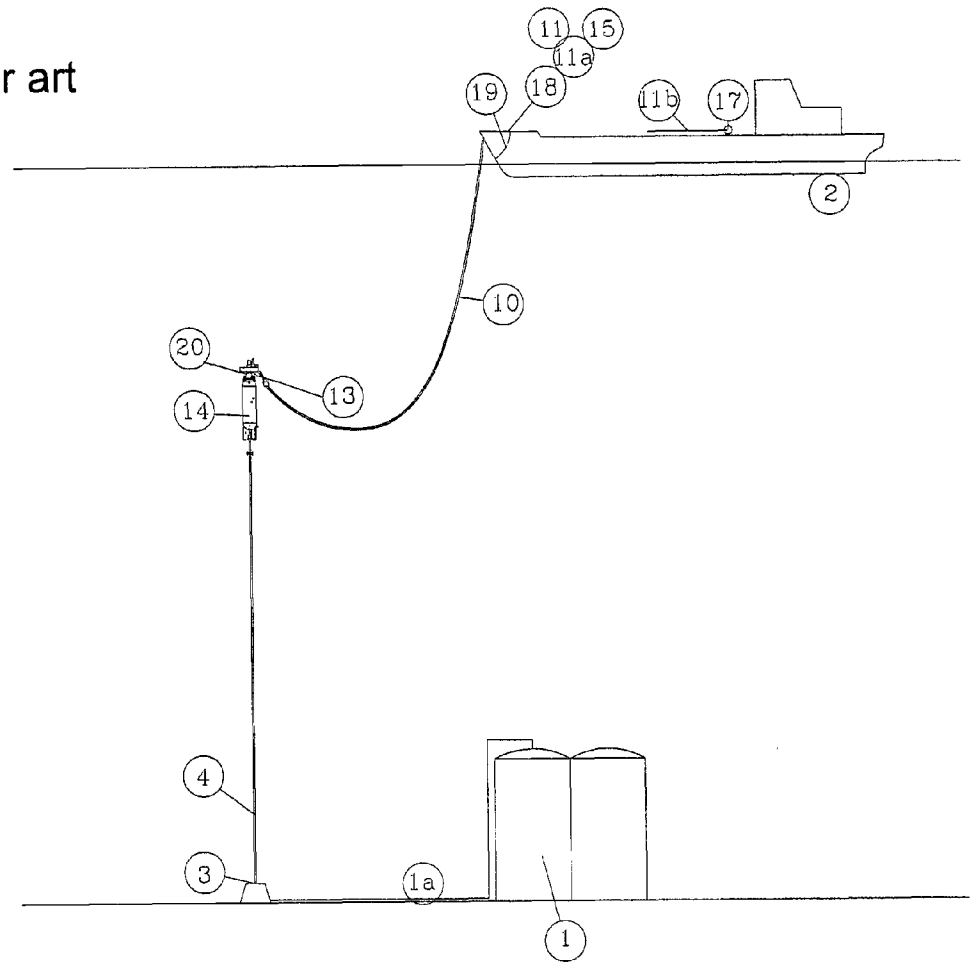
FIG. 1 illustrates a side view of a prior art system for transferring load from a sub sea storage device to the sea surface.

As described above with reference to FIG. 1, an active transfer device comprising gooseneck 13 and loading riser 10 is provided in the top of the tension buoy 14. The element of the transfer device may be a flexible hose/riser 10, which is hanging freely down from the tension buoy 14 when not in use. Since the tension buoy 14 and the loading riser 10 are submerged in the sea, they will not be damaged by vessels on the surface 5 or during bad weather conditions.

Figure 2:
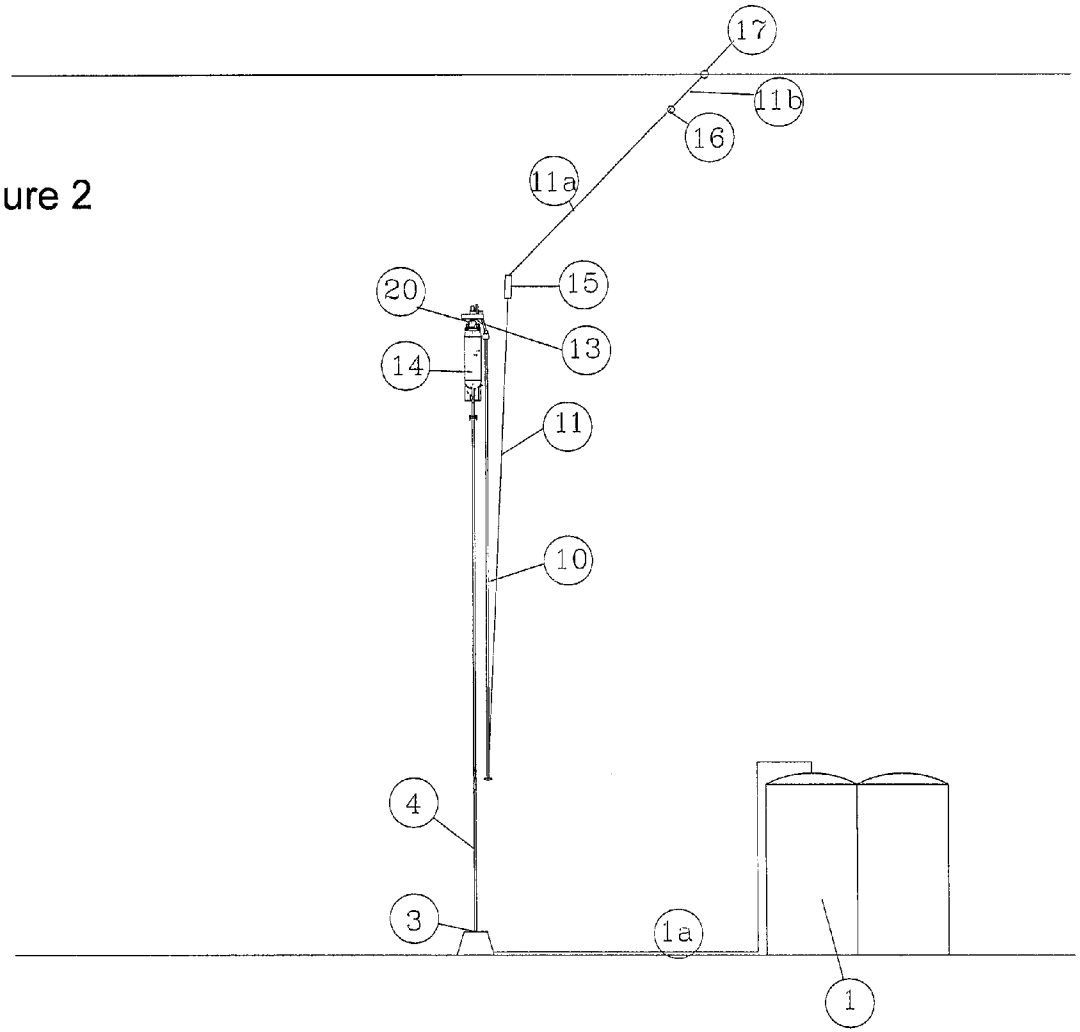
FIG. 2 illustrates a side view of that prior art system.

As shown in FIG. 2, a pickup line 11, 11*a*, 11*b* is used for picking up the loading riser 10 from sea when load is to be transferred from the tension buoy 14 to the vessel 2 on the sea surface 5. The pickup line 11 is connected to the loading riser 10 at its end away from the tension buoy 14. The pickup line 11 leads to a spring buoy 15. The spring buoy 15 is connected to an intermediate pick up line 11*a*, a master link 16 and an upper pickup line 11*b* terminated in the marker buoy 17 available at the sea surface. One or several marker buoys 17 can be provided in the second end of the upper pickup line 11*b* for easy access from the vessel.

Figure 5:
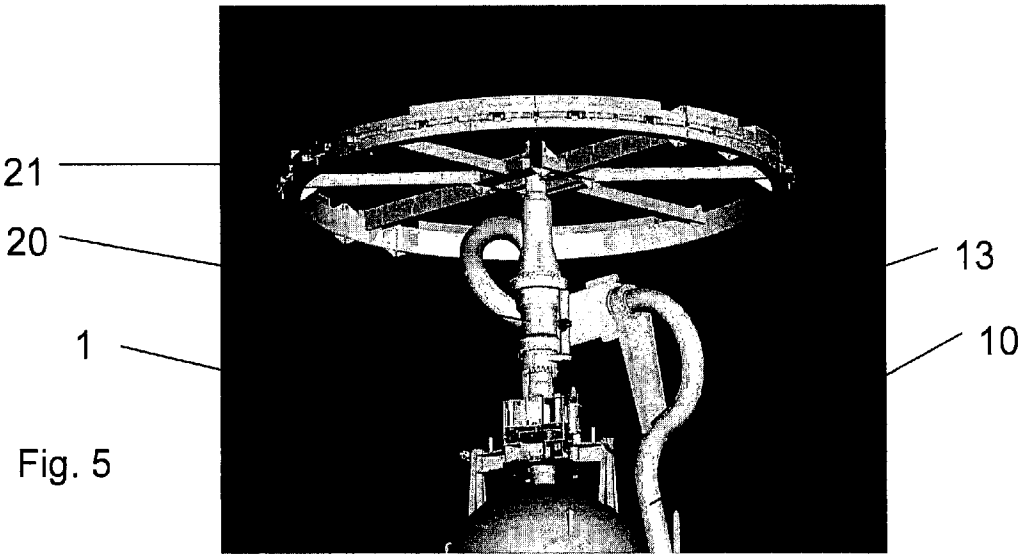
FIG. 5 illustrates details of the embodiment in FIG. 3.

The system comprises a swivel device 20 for connection of the loading riser 10 to the tension buoy 14. The swivel device 20 ensures that fluid communication with the tension buoy 14 is possible for the different positions that the tanker 2 may have in relation to the tension buoy 14. The swivel device 20 would be familiar for a person skilled in the art. More details of the swivel device are shown in FIG. 5.

Alternatively, the vertical swiveling device 20 may be located under the tension buoy 14. Hence, also the tension buoy 14 may be oriented according to the weather conditions together with the loading riser 10 and the pickup line 11.

The last alternative mentioned above refers to very deep water. Here the vertical swivelling function can sometimes be replaced by the elastic rotation of the rigid riser. Hence the vertical swivel is no longer necessary.

The "catching wheel" is suited to work equally well for all alternatives.

The system further comprises a horizontal swiveling device for rotation of the loading riser 10 and the pickup line 11 in relation to the tension buoy 14. The loading riser 10 and the pickup line 11 will then orient themselves according to the influence of weather conditions, such as waves/currents in the sea.

In accordance with the invention, the system further comprises a position limiting device 21 fixed to the swivel 20, for limiting the position of the pickup line 11 in relation to the tension buoy 14. The position limiting device 21 may be located above the gooseneck connection device 13. This will be explained more in detail with reference to FIGS. 4*a* and 4*b*.

Figure 4A:
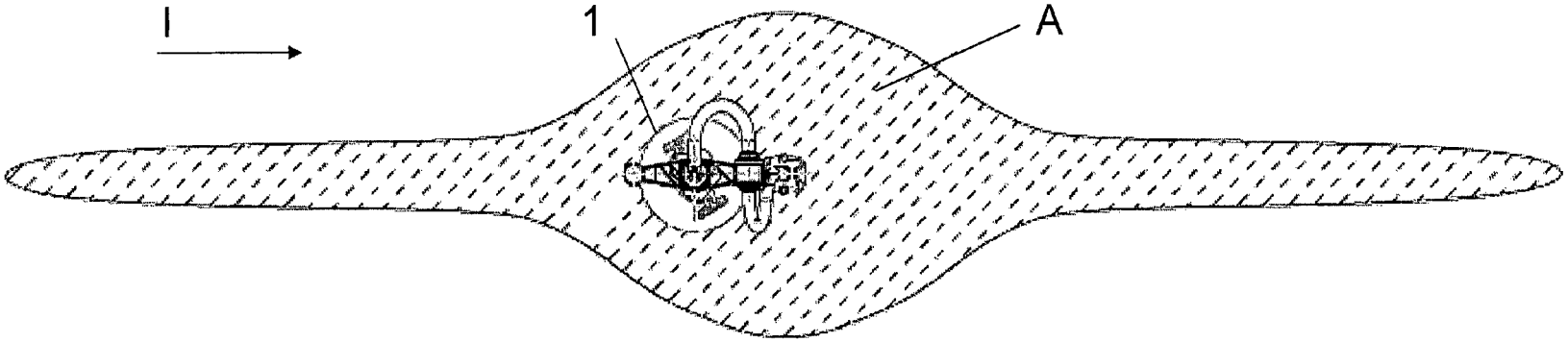
FIG. 4*a* illustrates a pickup line zone of the prior art system in FIG. 1.

In FIG. 4*a* (prior art), area A illustrates the different positions the pickup line 11 may have in relation to the tension buoy 14, as viewed from above in a coordinate system which rotates with the vertical swivel. The borderline is calculated in such a way, that the swivel will start to swivel for a sea current which is also strong enough to pull the pick up line over the edge of the area A. The borderline curve is referred to as the pick up line envelope.

In the worst conceivable sea current situation, the pick up line will transit to the edge of area A. If the combination of the current magnitude and direction now increases further, the pick up line will move in the fixed coordinate system, but so would the swivel and the gooseneck. The net effect is that the pick up line always stays inside the pick up line envelope Hence area A follows the rotation of the swiveling device round its rotation axis (i.e. in FIGS. 4*a* and 4*b*, the dominant direction of the sea currents is from left to right as indicated by arrow I). The area A in FIG. 4*a* is computed mathematically, and depends upon factors such as the friction of rotation, the size/buoyancy of the spring buoy 15 and the geometry of the gooseneck connection device 13. The current profile also enters the equations, and the current profile used is the worst conceivable combination of magnitude and direction over the water column.

The worst conceivable combination of magnitude and direction over the water column is a mathematical construct, which cannot possibly be exceeded by any physical combination of current speed and direction throughout the water column. Hence it is independent of local current patterns all over the world.

Figure 4B:
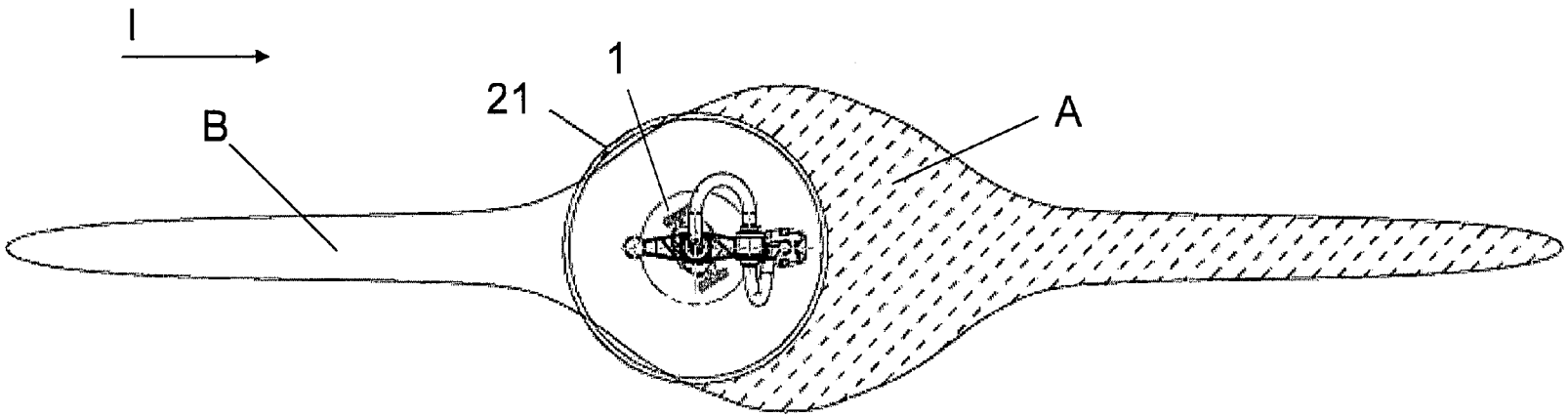
FIG. 4*b* illustrates the pickup line zone of the system in FIG. 3.

In the present invention shown in FIG. 4*b*, the position limiting device 21, intersects the periphery of the area A and divides the area into three parts. The pick up line can obviously no longer transit inside the position limiting device 21, indicated by area C. But it is also prevented from transiting around the limiting device for reasons described above.

Hence area B is also off limits, provided the tanker drops the line in the direction of area A, (which it always does as described earlier).

Hence, the position limiting device 21 limits the possible positions for the pickup line 11. So since area C is excluded, the pickup line will not get entangled by any of the details on the swivel 13 or the tension buoy 14. Since area B is also excluded, the pickup line will not get wrapped around the tension buoy 14 or the rigid riser 4. This is precisely what the invention aimed to achieve.

Figure 9A:
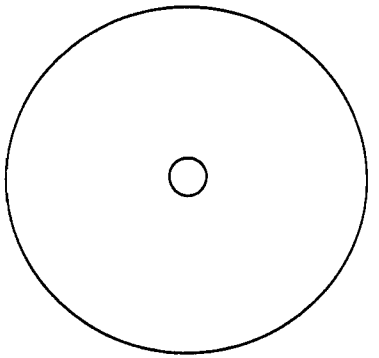
FIGS. 9*a* to 9*d* show variants of a component of the catching device.
Figure 9B:
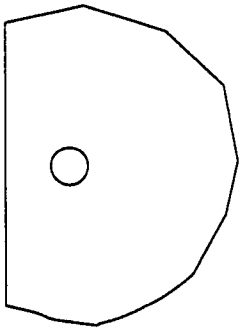
Figure 9C:
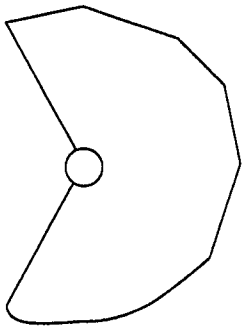
Figure 9D:
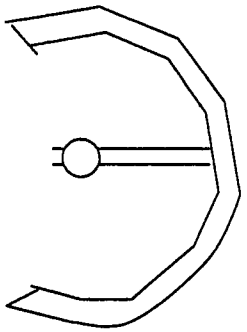

In FIG. 5 the position limiting device 21 is shown in more detail. The position limiting device 21 may be substantially circular, as indicated in FIG. 9*a*, for example provided as a wheel with spokes or alternatively as a substantially circular plate device. However, the position limiting device 21 may have other shapes as well, such as a substantially semi-circular shape as shown in FIGS. 9*b* and 9*c*, or a substantially curved form, where the outer periphery of the curve faces towards area A as in FIG. 5.

Figure 6:
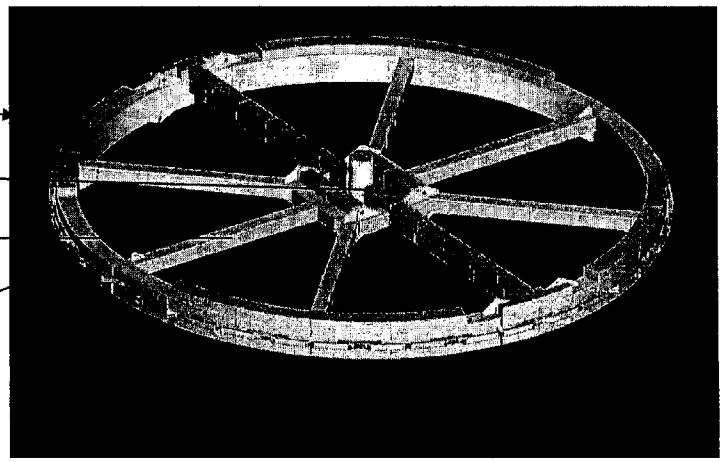
FIG. 6 illustrates a perspective view of the position limiting device of FIG. 5.

In the embodiment shown in FIG. 6, the position limiting device 21 is a fabricated wheel structure, comprising a hub 22 in the rotation centre, spokes 23 extending radially from the hub 22 to a peripheral member 24, which in this embodiment is a wheel. The hub 22 is fixed to the connection device 13, i.e. rotation of the peripheral member 24 is performed by means of the position limiting device 21. The position limiting device 21 may also include buoyancy elements. Such buoyancy elements are secondary to the invention, but may be preferred in some cases.

Two fundamental alternatives are possible for this arrangement.

A. Integration of the installation running tool for possible maintenance of the swivel with the position limiting device. Alternative A is for those parts of the world where availability of large and expensive vessels necessary for traditional swivel replacement is limited.

B. Adjustment for the off centre centre-of-buoyancy of the active transfer device 13 and 10. Alternative B is for waters with relatively high surface currents.

Figure 7:
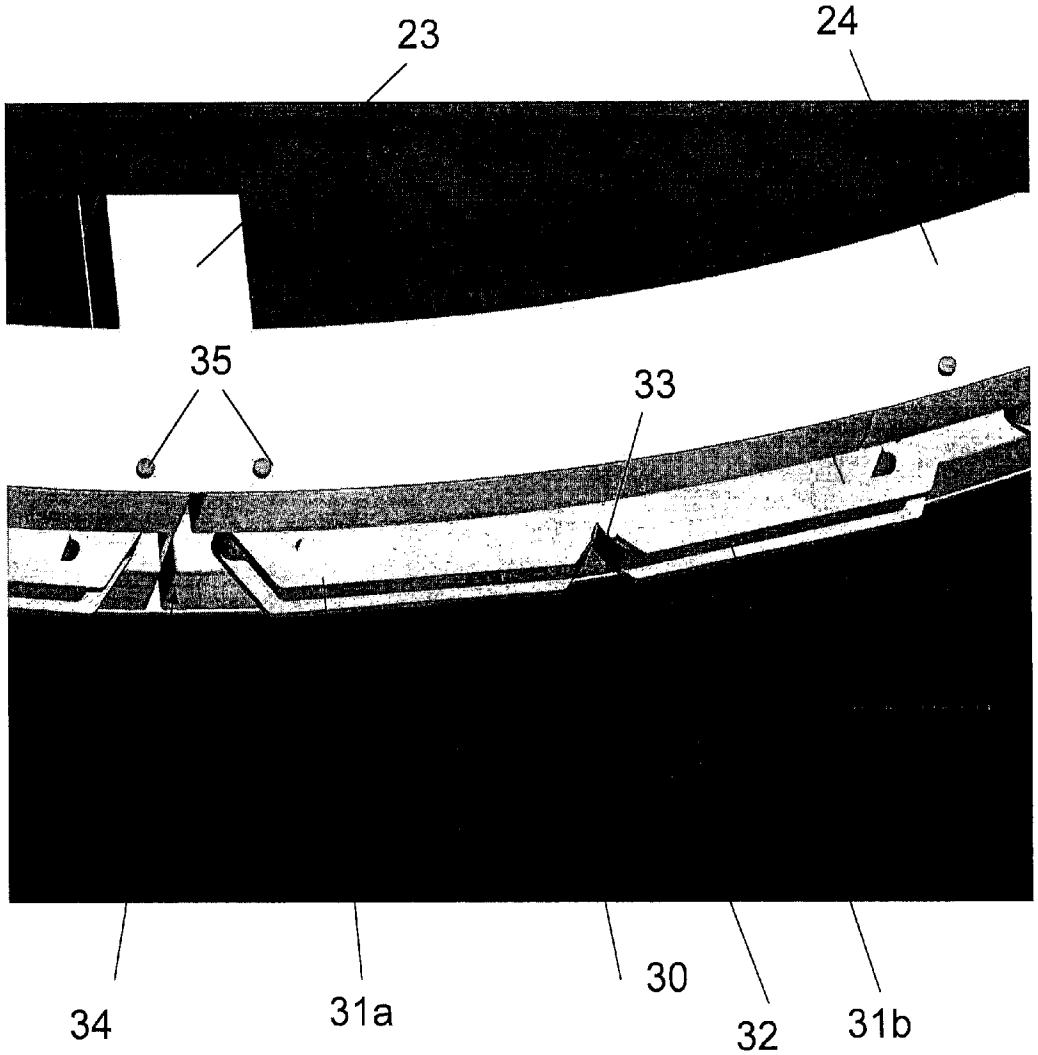
FIG. 7 illustrates an embodiment of the catching device of the position limiting device shown in FIG. 6.

Referring to FIG. 7, the position limiting device 21 may include a catching device 30 for catching and holding the pickup line 11. The catching device 30 may be provided on the periphery of the wheel 24.

In the embodiment shown in FIG. 7, the catching device 30 comprises a pair of catching arms 31*a*, 31*b* provided substantially in parallel with, and outside of, the periphery of the position limiting device 21. In this setting, the periphery of the position limiting device 21 is similar to the periphery of the wheel 24. An opening 32 is provided between the pair of catching arms 31*a*, 31*b* for catching the pickup line between the catching arms 31*a*, 31*b* and the periphery of the position limiting device 21.

Hence, when the pickup line 11 moves to a position near the periphery of the position limiting device 21, the pickup line 11 will slide along it, and it will enter the opening 32. In this situation, the pickup line 11 will be caught between one of the catching arms 31*a*, 31*b* and the periphery of the position limiting device 21 or wheel 24.

The opening 32 between the pair of catching arms 31*a*, 31*b* may be provided with a locking device 33 for preventing the pickup line from exiting from the catching device 30 through the opening 32. The locking device 33 may comprise a curved plate fixed to each end of the catching arm near the opening 32, where each curved plate protrudes into the area between the periphery of the wheel 24 and the catching arm. In this way, the curved plates may guide the pickup line through the opening 32, while the plates prevent the pickup line 11 from exiting through the opening 32.

Several such pairs of catching arms are provided along the periphery of the position limiting device 21/the periphery of the wheel 24. Moreover, a space 34 between each pair of catching arms may have a cover (not shown) to guide the pickup line 11 further to the nearest opening 32.

Each catching arm 31*a*, 31*b* may be pivotally fastened to the peripheral member of wheel 24 of the position limiting device 21, for example by means of a pivot axle or fastening pin 35. Each catching arm is pretensioned and is held in its initial position as shown in FIG. 7. For example, the catching arms may be pretensioned by means of a spring device (not shown).

Figure 3:
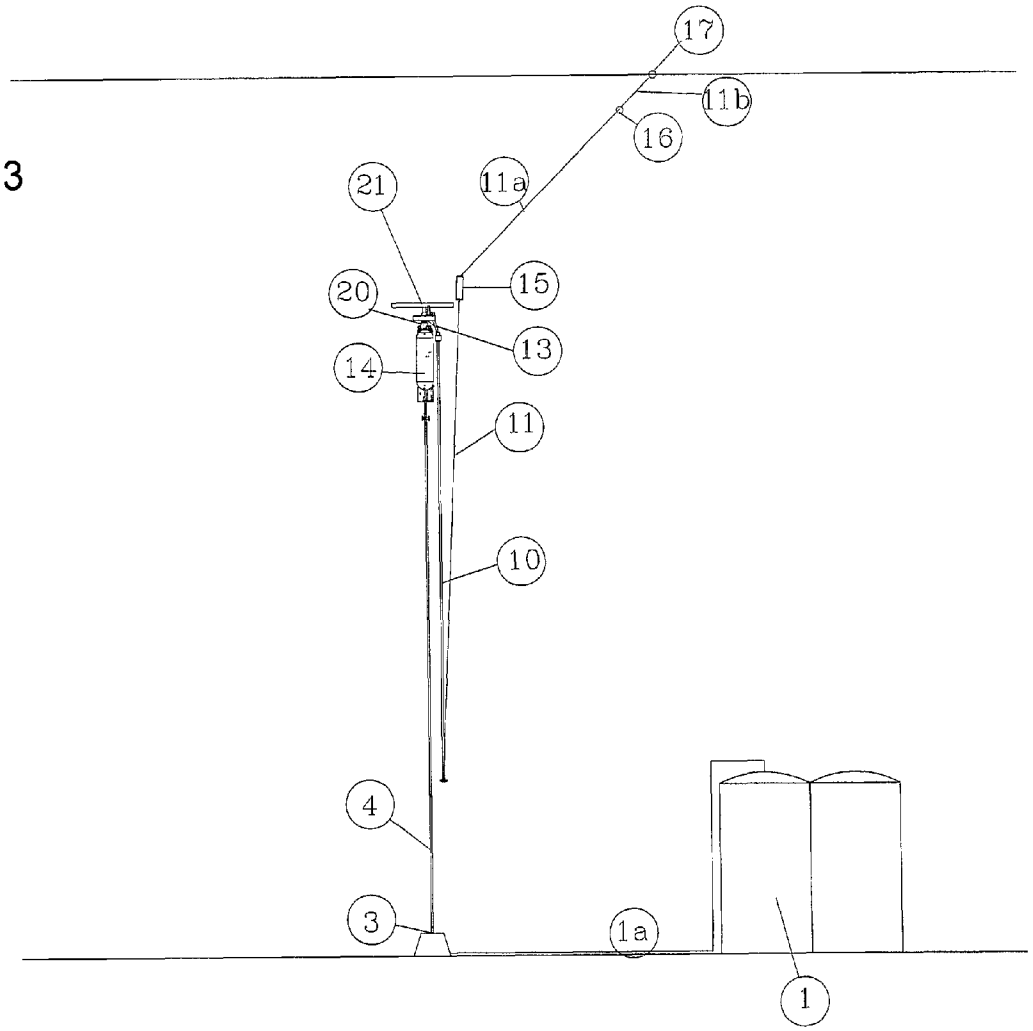
FIGS. 3, 3*a* and 3*b* illustrate a side view of a system according to one embodiment of the invention in place.

Hence, the catching device 30 includes a releasing mechanism for releasing the pickup line 11 from the catching device. The releasing mechanism is provided for release of the pickup line 11 when a traction force in the pickup line 11 reaches a predetermined limit. The predetermined limit is set such that the releasing mechanism does not activate because of sea currents etc, but only if a tanker starts to pull in the pick up line. It should be noted that in normal situations, the vessel is not located above the tension buoy, but is located for example 20-60 meters from the tension buoy 14—see FIG. 3*c*. Hence, the traction force from the vessel has a considerable horizontal component.

Figure 8:
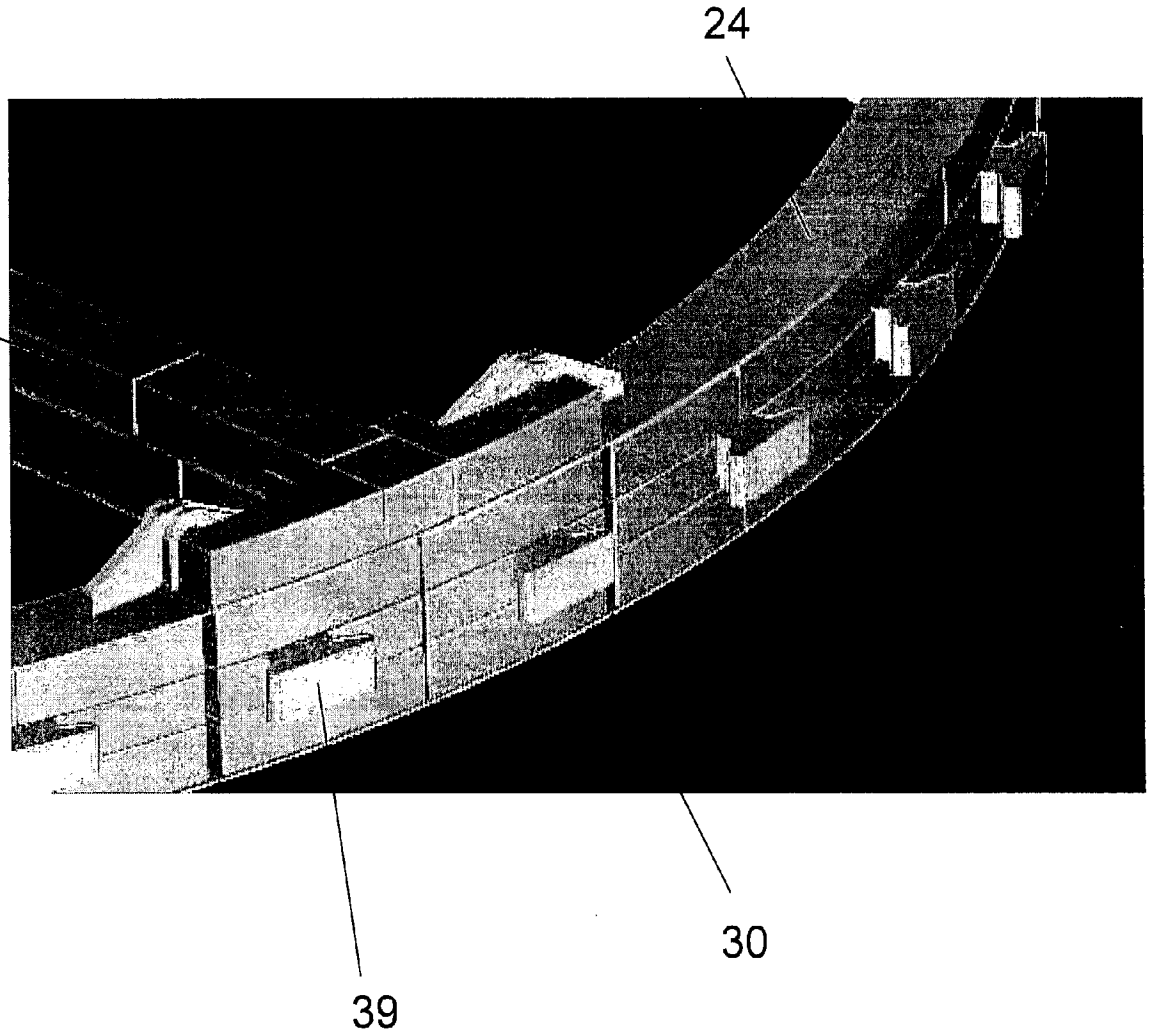

An alternative embodiment of the catching device 30 is shown in FIG. 8. Here, the catching device 30 comprises substantially T-shaped catching elements 39 protruding radially from the periphery of the position limiting device 21.

In this embodiment, when the pickup line 11 moves to a position near the periphery of the position limiting device 21, the pickup line 11 will slide along it, and it will be caught by the T-shaped catching elements 39. This will prevent the pick up line from sliding any further along the wheel circumference. But whenever the current changes direction, the pick up line may slip out of the T shaped catch and it will re-enter area A of the pick up line envelope as shown in FIG. 4*b*. As we have seen earlier the line may stay indefinitely in this area without causing any problems, but it will of course re-enter the T-catch 39 regularly.

Now if the tanker 2 approaches when the pick up line is in area A on FIG. 4*b*, pickup will happen without any restrictions whatsoever. If it is inside the T-shaped catching element 39 at the time of pick up the following will happen:

As soon as the traction force in the pickup line increases, the position limiting device 21 together with the gooseneck connection device 13 will rotate around the rotation axis of the swiveling device, until the T-shaped catching element 39 is at an attitude where it releases the pickup line again along the slanted surface under the T.

ADVANTAGES OF THE INVENTION

The position limiting device keeps the pick up line away from the complex details on top of the tension buoy. Hence entanglement is eliminated.

The critical diameter or circumferential size of the position limiting device is large enough to prevent the currents from taking the pick up system around the position limiting device. The selected diameter is above this value. Hence wrapping of the rigid riser is eliminated.

Figure 3B:
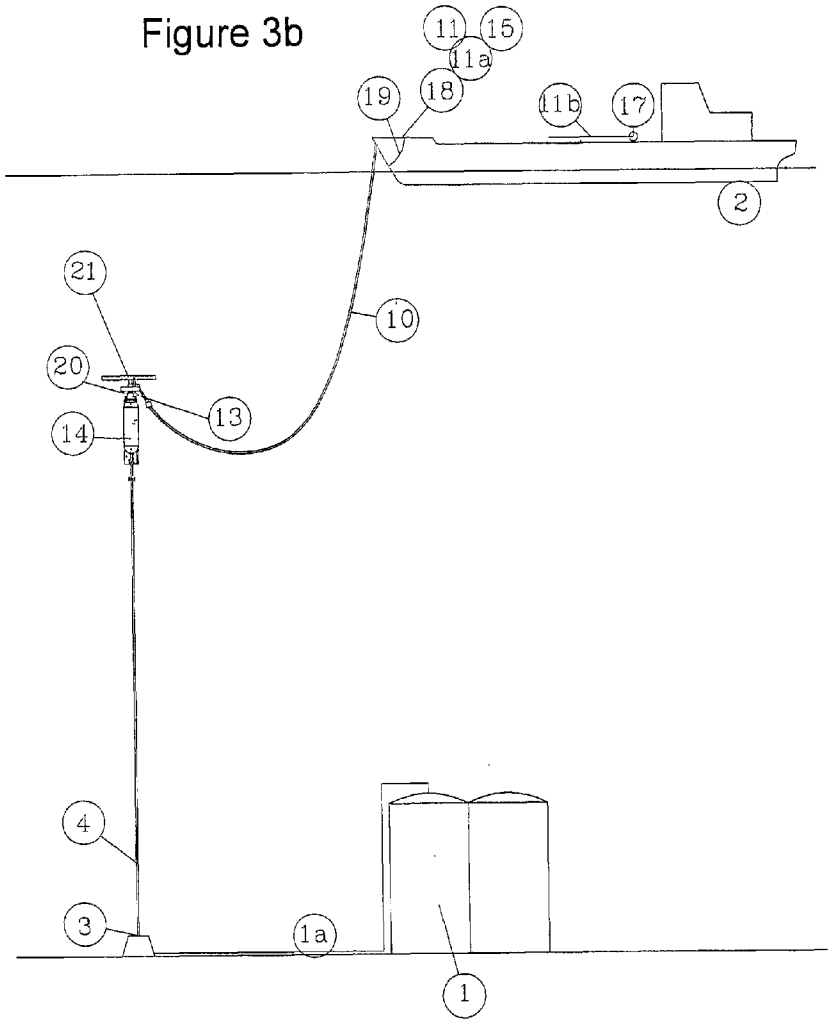
Figure 3A:
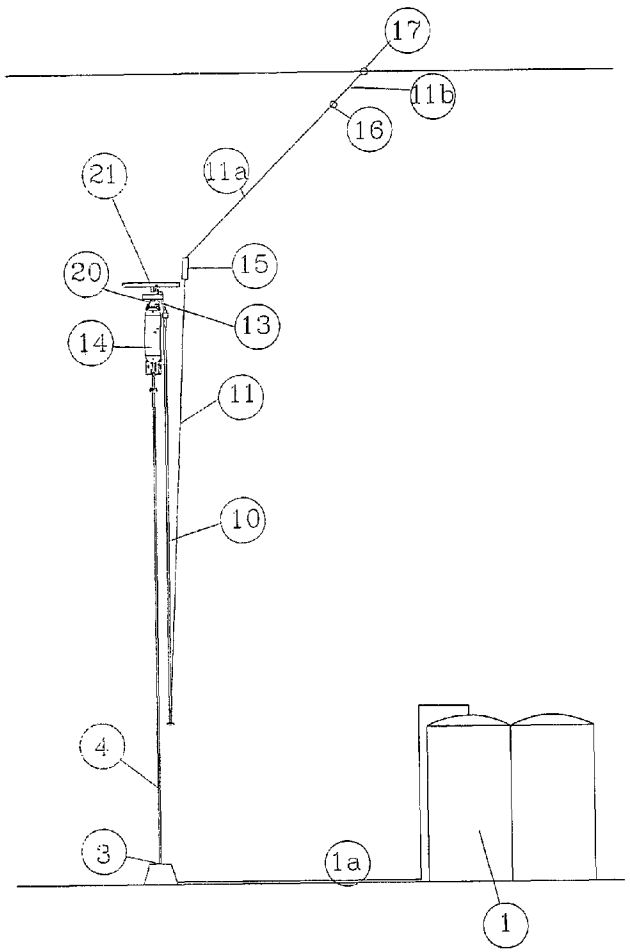

The present invention is mainly active during the standby period. FIG. 3*a* shows the loading system with the position limiting device 21 installed in the stand by phase. FIG. 3*b* shows the situation during loading. As seen, the position limiting device 21 does not affect the loading operation, and makes a significant difference operationally during the pick up operation.

The invention claimed is:

1. System for handling a transfer device for transferring fluid loads from a subsea tension buoy to a vessel on the sea surface, comprising:

a connection device for connection of the transfer device to the tension buoy, where the transfer device is hanging from the connection device when no fluid loads is being transferred;

a pickup line comprising a first end connected to the transfer device and a second end available at the sea surface;

a swiveling device connected between the connection device and the tension buoy for rotation of the connection device in relation to the tension buoy;

a position limiting device fixed above the connection device, for limiting the position of the pickup line in relation to the tension buoy; where the pickup line is provided in a tensioned state at least up to the level of the position limiting device.

2. System according to claim 1, where the swiveling device is provided for free rotation of the connection device substantially in a horizontal plane according to influence from the sea.

3. System according to claim 1, where the position limiting device comprises a catching device for catching and holding the pickup line.

4. System according to claim 3, where the catching device comprises a releasing mechanism for releasing the pickup line from the catching device.

5. System according to claim 4, where the releasing mechanism is provided for release of the pickup line when a traction force in the pickup line reaches a predetermined limit.

6. System according to claim 3, where the catching device comprises a pair of catching arms provided substantially in parallel with, and outside of, the periphery of the position limiting device, where an opening is provided between the pair of catching arms for catching the pickup line between the catching arms and the periphery of the position limiting device.

7. System according to claim 6, where the opening between the pair of catching arms is provided with a locking device for preventing the pickup line from exiting from the catching device through the opening.

8. System according to claim 6, where the catching arms are pivotally fastened to a peripherical member of the position limiting device.

9. System according to claim 8, where the catching arms are pretensioned by means of a spring device.

10. System according to claim 3, where the catching device comprises substantially T-shaped catching elements protruding from the position limiting device.

11. System according to claim 1, where the position limiting device is substantially circular.

* * * * *